US005881554A

United States Patent [19]

Novak et al.

[11] Patent Number: 5,881,554

[45] Date of Patent: Mar. 16, 1999

[54] INTEGRATED MANIFOLD, MUFFLER, AND CATALYST DEVICE

[75] Inventors: James Michael Novak, Dearborn Heights; Kristofor Robert Norman, Farmington Hills, both of Mich.

[73] Assignee: Ford Global Technologies, Inc., Dearborn, Mich.

[21] Appl. No.: 46,017

[22] Filed: Mar. 23, 1998

[51] Int. Cl.[6] ..... F01N 3/10

[52] U.S. Cl. ..... 60/302; 60/323; 181/240

[58] Field of Search ..... 60/302, 301, 323; 181/240, 238, 249, 251

[56] References Cited

U.S. PATENT DOCUMENTS 3,166,895 1/1965 Slayter et al. .
3,644,098 2/1972 DePalma et al. .
3,957,446 5/1976 Mayer et al. .
5,109,668 5/1992 Lindstedt ..... 60/310
5,220,789 6/1993 Riley et al. ..... 60/302
5,325,666 7/1994 Rutschmann .
5,351,483 10/1994 Riley et al. .
5,373,119 12/1994 Suzuki et al. .
5,548,955 8/1996 Sandefur et al. .

*Primary Examiner*—Thomas E. Denion
*Assistant Examiner*—Binh Tran
*Attorney, Agent, or Firm*—Neil P. Ferraro

[57] ABSTRACT

An integrated manifold, muffler, and catalyst device for an engine uses perforated ducts surrounded by a resonator volume. Exhaust flow is routed from the exhaust ports by the ducts to a close coupled catalyst. The combination of the perforated ducts with the resonator volume and close coupled catalyst reduces exhaust flow restriction while at the same time increasing catalyst performance and reducing noise emissions.

6 Claims, 1 Drawing Sheet

INTEGRATED MANIFOLD, MUFFLER, AND CATALYST DEVICE

FIELD OF THE INVENTION

The invention relates to collecting, treating, and dispersing exhaust gases from an internal combustion engine.

BACKGROUND OF THE INVENTION

Integrated muffler, manifold, and catalyst devices for vehicles having an internal combustion engine are desirable because of the decreased space and weight requirements and the associated cost benefits. They accomplish the goal of reducing emissions, suppressing noise, and directing exhaust flow in a single package. Conventional systems use a cavity for creating a manifold for interfacing to the exhaust ports, a single expansion chamber for expanding the exhaust gas, a concentrating volume for converging the flow into a laminar flow catalyst, and a second concentrating volume for further converging the flow. The single expansion chamber reduces low frequency noise, while the effect of the convergent regions and laminar flow catalyst reduce high frequency noise. Having the catalyst in close proximity to the exhaust ports decrease the heat energy lost from the exhaust gas, thereby decreasing catalyst temperature light-off times and increasing emission control. Such a system is disclosed in U.S. Pat. No. 5,351,483.

The inventors herein have recognized numerous disadvantages with the above approaches. One disadvantage is that the exhaust flow restriction created by the combined manifold, muffler, and catalyst is less than optimal due to the sudden expansion experienced by the exhaust gas when entering the expansion chamber, thereby causing available engine horsepower to decrease from optimal. Another disadvantage is that the large resonator, or expansion, volume needed to suppress low frequency noise increases thermal mass, thereby increasing catalyst light-off time despite the close coupled location of the catalyst. An increase in catalyst light-off time is unsatisfactory because of the corresponding decreased emissions reduction.

SUMMARY OF THE INVENTION

An object of the invention claimed herein is to provide an integrated manifold, muffler, and catalyst device for an engine with decreased catalyst light-off time, decreased flow resistance, and increased noise suppression.

The above object is achieved, and problems of prior approaches overcome, by an integrated exhaust treatment device coupled to a plurality of exhaust ports of an internal combustion engine for receiving exhaust gas therefrom. The device comprises a housing, a manifold portion formed within said housing, a plurality of ducts formed within said manifold portion, and a catalyst portion formed within said housing. The manifold portion defines a volume comprising a plurality of entrance holes adapted for alignment with exhaust ports of the engine. The plurality of ducts occupy a part of said volume of said manifold portion, with said ducts having an inlet adjacent to said entrance holes, an outlet, and a plurality of perforates formed along the length of said ducts, thereby allowing said ducts to be in fluid communication with a remaining part of said volume of said manifold. The catalyst portion is in fluid communication with said outlet of said ducts.

The perforated ducts in the manifold portion of the housing reduce the flow losses related to the sudden expansion and necessary contraction of the exhaust flow which would occur in a conventional expansion volume. However, in the present invention, noise suppression is accomplished by the perforations, which allow the surrounding volume to act as the resonator. Using the ducts in this fashion also reduces the mixing of the exhaust flow in the manifold portion of the housing which decreases thermal mass and decreases catalyst light-off time. Further, the ducts allow the flow to be directed as desired to form a more uniform flow entering the catalyst. Also, locating the perforates on the inside radius of any bend in the ducts forms turbulent flow, additionally decreasing flow resistance.

An advantage of the present invention is that the device reduces cost and complexity while increasing available packaging space.

Another advantage of the present invention is an increase in engine performance and fuel economy due to the decreased flow resistance.

Still another advantage of the present invention increased catalyst performance because of the decreased catalyst light-off time.

Yet another advantage of the present invention is further increase in catalyst performance due to the more uniform flow distribution.

Other objects, features and advantages of the present invention will be readily appreciated by the reader of this specification.

BRIEF DESCRIPTION OF THE DRAWINGS

The invention will now be described, by way of example, with reference to the accompanying drawing, in which.

DESCRIPTION OF THE PREFERRED EMBODIMENTS

Figure 1:
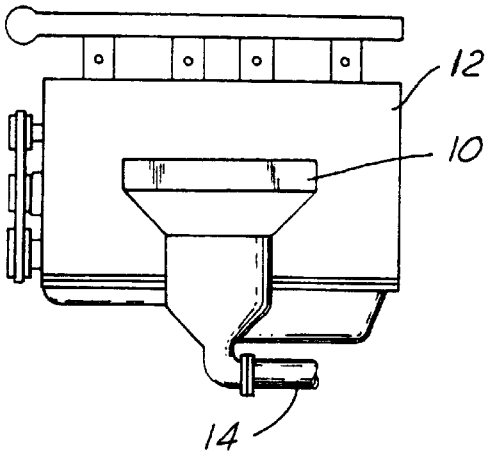
FIG. 1 is a block diagram of an engine with an exhaust system in which the invention is used to advantage.

Exhaust treatment device 10, shown in FIG. 1, is coupled between exhaust ports of engine 12 and tailpipe 14 and is used to treat both sound emissions and exhaust gas emissions. Engine 12 may be an engine comprising three, four, or six cylinders inline therein, or any number of inline cylinders. As used herein, inline cylinders may be part of a conventional inline engine or part of a bank of cylinders of a conventional V-type engine.

Figure 2:
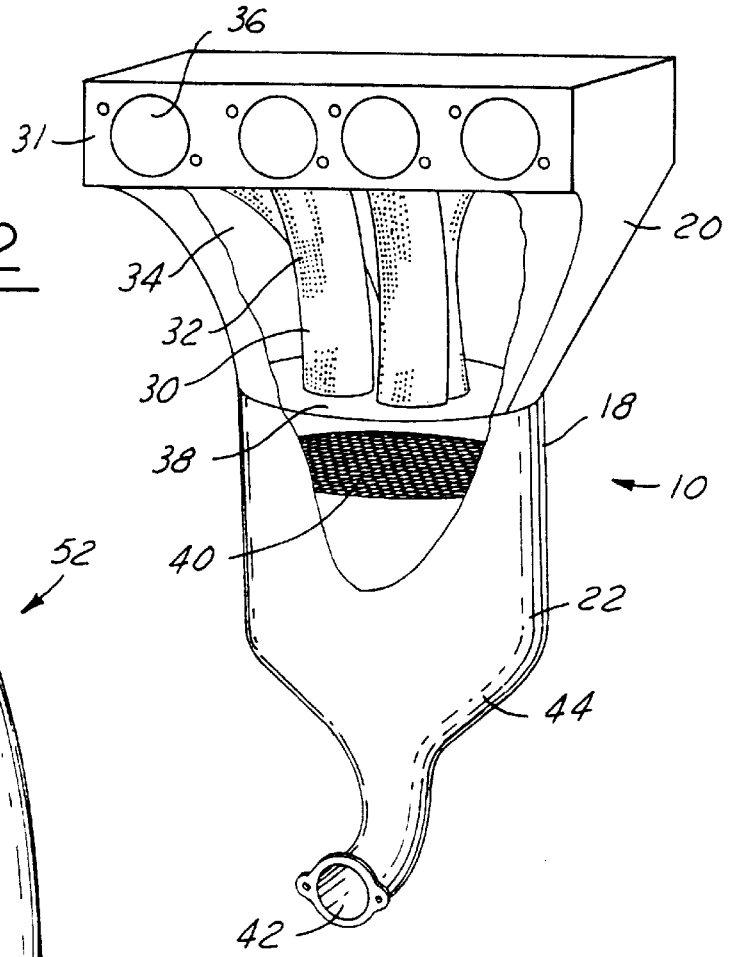
FIG. 2 is a schematic diagram of a preferred embodiment according to the present invention.

Device 10 includes housing 18 comprising manifold portion 20 and catalyst portion 22 as shown by the partial cutaway view in FIG. 2. Manifold portion 20 contains ducts 30 having a plurality of perforates 32. Ducts 30 also comprise bends. In this example, four ducts are shown for coupling with four cylinders of an engine. Manifold portion 20 may contain any number of ducts to be compatible with engine 12. Further, in the example of a V-type engine, device 10 may comprise two housings, one connected to each of the two banks of the V-type engine, which may or may not be joined by a Y-pipe downstream of the housings. Manifold portion 20 also contains flat surface 31 adapted to be connected to exhaust ports (not shown) of engine 12. Ducts 30 connect to exhaust ports (not shown) at entrance holes 36. Ducts 30 connect to catalyst portion 22 of housing 18 at catalyst inlet 38.

Catalyst portion 22 contains catalyst 40, with catalyst inlet 38 between catalyst 40 and manifold portion 20. In this example, catalyst 40 is a monolithic three-way catalyst, comprising a plurality of parallel aligned passages (not shown). However, those skilled in the art will recognize that catalyst 40 could be a NOx trap for use with a direct injection combustion system or any other lean-burn engine. Catalyst portion 22 also comprises reducing volume 44 between catalyst 40 and exit hole 42, where reducing volume 44 is located downstream of catalyst 40. Exit hole 42 is adapted to be connected to tailpipe 14 (see FIG. 1).

Exhaust gas flow from the engine (not shown) travels from the cylinder (not shown) through the exhaust ports (not shown) to entrance holes 36. From entrance holes 36 the exhaust flow is directed to catalyst inlet 38 by ducts 30. By directing the flow, there is low flow resistance compared with allowing a sudden expansion. The flow resistance is further minimized by placing perforates 32 on the inside radius only of ducts 30 as described later herein with particular reference to FIG. 3.

Perforates 32 allow fluid communication between exhaust gas in ducts 30 and exhaust gas in manifold volume 34. As the exhaust flow is traveling through ducts 30, perforates 32 allow manifold volume 34 to act as a resonator. This creates a sound dampening quality that reduces the noise emitted by the exhaust system. Also, ducts 30 are further used to direct the exhaust flow to catalyst entrance 38 so that a more uniform flow velocity distribution is obtained. Placing the catalyst directly after ducts 30 takes advantage of the uniform flow to increase utilization of the catalyst and thereby decrease emissions.

While ducts 30 may not completely isolate the exhaust flow from manifold volume 34, they do provide some insulation. This causes the temperature of the exhaust flow entering the catalyst to be higher than if no ducts were used. Because the temperature of the exhaust flow entering catalyst 40 is higher, more heat is rejected to catalyst 40. The increased heat rejection causes the catalyst light-off time to decrease, thereby increasing catalyst performance and reducing emissions. Also, because housing 18 is mounted directly to the exhaust ports (not shown), a close coupled catalyst configuration is achieved. Using a close coupled catalyst further takes advantage of the exhaust heat energy to decrease the catalyst light off time.

Reducing volume 44 of catalyst portion 22 is used to converge exhaust flow exiting catalyst 40 before the exhaust flow exits through exit hole 42. Converging the exhaust flow reduces high frequency noise emitted and also serves to allow a smaller diameter tail pipe 14 (see FIG. 1) to be connected to exit hole 42 for transporting the exhaust flow to the rear of the vehicle.

Figure 3:
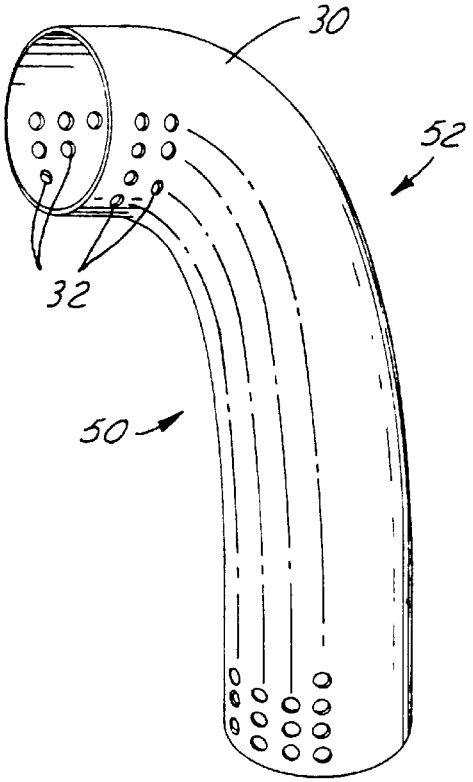
FIG. 3 is a schematic diagram of a portion of a preferred embodiment according to the present invention.

According to the present invention, as shown in FIG. 3, each of the ducts 30 may comprise bends that are necessary, due to the geometry of the engine and vehicle (not shown), to route the exhaust flow from the engine to catalyst 40. For example, ducts 30 may comprise a bend having inner bend 50 and outer bend 52. As exhaust flow travels through duct 30, the flow inside duct 30 adjacent to inner bend 50 may tend to break apart and increase overall flow resistance relative to a straight duct. In a preferred embodiment, perforates 32, located in inner bend 50, cause the flow within duct 30 adjacent inner bend 50 to become turbulent, which reduces the flow resistance. Perforates 50 also allow the exhaust flow to communicate with manifold volume 34 creating a resonator to dampen noise.

While the best mode for carrying out the invention has been described in detail, those skilled in the art in which this invention relates will recognize various alternative designs and embodiments, including those mentioned above, in practicing the invention that has been defined by the following claims.

We claim:

1. An integrated exhaust treatment device coupled to a plurality of exhaust ports of an internal combustion engine for receiving exhaust gas therefrom, the device comprising:

a housing;

a manifold portion formed within said housing and defining a volume comprising a plurality of entrance holes adapted for alignment with exhaust ports of the engine;

a plurality of ducts formed within said manifold portion and occupying a part of said volume of said manifold portion, with said ducts having an inlet adjacent to said entrance holes, an outlet, and a plurality of perforates formed along the length of said ducts, thereby allowing said ducts to be in fluid communication with a remaining part of said volume of said manifold; and a catalyst portion formed within said housing and being in fluid communication with said outlet of said ducts.

2. The integrated exhaust treatment device recited in claim 1 wherein said catalyst portion of the housing is in close proximity to said outlet of said ducts thereby operating as a close-coupled catalyst.

3. The integrated exhaust treatment device recited in claim 1 wherein said ducts comprise bends to allow said ducts to be in fluid communication with the entrance holes and the catalyst portion of the housing.

4. The integrated exhaust treatment device recited in claim 3 wherein said perforates are on an inner bend of said ducts.

5. The integrated exhaust treatment device recited in claim 1 wherein said catalyst portion of the housing further comprises a reducing volume located downstream of said catalyst for converging an exhaust flow exiting said catalyst.

6. An integrated exhaust treatment device coupled to a plurality of exhaust ports of an internal combustion engine for receiving exhaust gas therefrom, the device comprising:

a housing;

a manifold portion formed within said housing and defining a volume comprising a plurality of entrance holes adapted for alignment with exhaust ports of the engine;

a plurality of ducts formed within said manifold portion and occupying a part of said volume of said manifold portion, with said ducts comprising an inlet adjacent to said entrance holes, an outlet, and a plurality of perforates formed along the length of said ducts, thereby allowing said ducts to be in fluid communication with a remaining part of said volume of said manifold, said ducts further comprising bends to allow said ducts to be in fluid communication with the entrance holes and the catalyst portion of the housing, said perforates being on an inner bend of said ducts; and a catalyst portion formed within said housing and being in fluid communication with and in close proximity to said outlet of said ducts, thereby operating as a close-coupled catalyst, said catalyst portion comprising a reducing volume located downstream of said catalyst for converging an exhaust flow exiting said catalyst.

* * * * *